US011253084B2

(12) United States Patent
Goppion

(10) Patent No.: US 11,253,084 B2
(45) Date of Patent: Feb. 22, 2022

(54) MUSEUM SHOWCASE WITH A RACK AND PINION DRIVE SYSTEM FOR A SLIDING DOOR

(71) Applicant: GOPPION S.p.A., Trezzano Sul Naviglio (IT)

(72) Inventor: Alessandro Goppion, Milan (IT)

(73) Assignee: GOPPION S.p.A, Trezzano Sul Naviglio (IT)

( * ) Notice: Subject to any disclaimer, the term of this patent is extended or adjusted under 35 U.S.C. 154(b) by 0 days.

(21) Appl. No.: 16/887,566

(22) Filed: May 29, 2020

(65) Prior Publication Data

US 2020/0375373 A1 Dec. 3, 2020

(30) Foreign Application Priority Data

May 31, 2019 (IT) ..... 102019000007767

(51) Int. Cl.

| | |
|---|---|
| ***A47F 3/04*** | (2006.01) |
| ***A47F 3/00*** | (2006.01) |
| ***A47F 3/12*** | (2006.01) |
| ***E05F 15/635*** | (2015.01) |

(52) U.S. Cl.

CPC ..... *A47F 3/043* (2013.01); *A47F 3/005* (2013.01); *A47F 3/125* (2013.01); *E05F 15/635* (2015.01); *E05Y 2201/722* (2013.01); *E05Y 2800/21* (2013.01); *E05Y 2900/202* (2013.01)

(58) Field of Classification Search

CPC ..... A47F 3/043; A47F 3/125; A47F 3/005; A47F 3/0404; A47F 3/0426; A47F 3/0434; A47F 3/12; E05F 15/635; E05Y 2900/20; E05Y 2900/202; E05Y 2800/21; E05Y 2201/62; E05Y 2201/722

USPC ..... 49/326, 362

See application file for complete search history.

(56) References Cited

U.S. PATENT DOCUMENTS

| | | | | |
|---|---|---|---|---|
| 4,744,172 A * | 5/1988 | Miyauchi | ..... | E05F 11/481 49/349 |
| 9,345,341 B2 * | 5/2016 | Goppion | ..... | A47B 45/00 |
| 2012/0032570 A1 * | 2/2012 | Friesenecker | ..... | E05F 15/63 312/319.6 |

(Continued)

FOREIGN PATENT DOCUMENTS

| | | | | |
|---|---|---|---|---|
| DE | 19821870 A1 * | 11/1999 | ..... | E04B 2/825 |
| DE | 102007024676 A1 * | 11/2008 | ..... | E05D 15/1013 |
| EP | 2868854 A1 * | 5/2015 | ..... | E05F 15/643 |

(Continued)

OTHER PUBLICATIONS

Translated Description KR20090098240A, 4 pages (Year: 2009).*

*Primary Examiner* — Andrew M Roersma
(74) *Attorney, Agent, or Firm* — Husch Blackwell LLP

(57) ABSTRACT

The museum showcase comprises a casing with at least one open side, a sliding door for closing the open side of the casing, a guide system to allow the horizontal displacement of the sliding door with respect to the casing, and an actuation system to cause the displacement of the sliding door on the guide system. The actuation system comprises a rack, integral with the sliding door and extending in the direction of its width, two drive pinions rotatably mounted on the casing and in meshing engagement with the rack. The two pinions are arranged spaced apart from each other in the direction of the width of the open side of the casing. It follows a very wide opening of the showcase.

8 Claims, 4 Drawing Sheets

(56) References Cited

U.S. PATENT DOCUMENTS

2016/0331153 A1* 11/2016 Goppion ..... A47F 3/125

FOREIGN PATENT DOCUMENTS

| | | | | | |
|---|---|---|---|---|---|
| FR | 2603787 | A1 * | 3/1988 | ..... | A47F 3/002 |
| KR | 1020090098240 | A | 9/2009 | | |
| KR | 1020180024858 | A * | 3/2018 | | |
| WO | 2015111009 | A1 | 7/2015 | | |

* cited by examiner

MUSEUM SHOWCASE WITH A RACK AND PINION DRIVE SYSTEM FOR A SLIDING DOOR

CROSS REFERENCE TO RELATED APPLICATIONS

This application claims priority to Italian Application No. 102019000007767 filed on May 31, 2019, the disclosure of which is incorporated herein by reference.

TECHNICAL FIELD

The present invention relates to a museum showcase, that is a showcase for preserving and displaying objects, such as typically artworks, cultural heritage objects or in any case delicate objects, in museums, exhibitions and the like.

BACKGROUND

In the following, even where only the term showcase is used, it must be understood that it refers to a museum showcase.

In particular, a showcase can simply enclose the artworks, preventing the contact by people or things, or it can be such as to guarantee the preservation of the artworks in a protected environment; protected environment means here and hereinafter an environment in which the atmosphere is controlled, by monitoring one or more parameters among temperature, humidity, dust content, pollutant content, in order to maintain the expected conditions of preservation of the exhibits, and in which the possibility of access to unauthorized personnel is prevented, to avoid theft or damage to the exhibits.

Showcases of this type must therefore meet various requirements, in relation to preservation and integrity of the exhibits. In addition, these showcases must of course guarantee the best visibility for the exhibits.

In order to improve visibility, showcase manufacturers try as far as possible to use transparent materials—typically glass—for the fixed walls and the openable doors of the showcases. In addition to ensuring the best visibility of the exhibits, the extensive use of glass is often desired by showcase designers because the transparency of the material makes it possible to give maximum prominence to the exhibits. However, this material implies a rather high weight, which can create difficulties in moving the openable doors.

In addition, to facilitate the insertion and removal of the exhibits, showcases with sliding doors are often used with respect to a fixed casing, wherein the opening takes place by sliding an openable door that practically forms an entire wall or a large part thereof.

In a showcase with sliding doors, it is appropriate that the sliding of the door is such as to leave an opening as wide as possible, so as to facilitate access to the inside of the showcase for the placement of objects, the removal thereof or even just the control thereof.

There is therefore the problem of realising showcases with sliding doors, in which it is possible to guarantee a wide opening of the door.

SUMMARY

Accordingly, the present invention relates to a showcase as described and claimed herein.

More particularly, according to the invention, the museum showcase comprises a casing with at least one open side, a sliding door for closing the open side of the casing, a guide system to allow the horizontal displacement of the sliding door with respect to the casing and an actuation system to cause the displacement of the sliding door on the guide system.

wherein the actuation system comprises:

a rack, integral with the sliding door and extending in the direction of its width, two drive pinions rotatably mounted on the casing and in meshing engagement with the rack, in which the two pinions are arranged spaced apart from each other in the direction of the width of the open side of the casing.

The presence of the two pinions allows a very wide opening of the showcase. In fact, during sliding starting from the closing position of the door, there is a first phase in which the rack is in meshing engagement with both pinions, followed by a second phase in which one of the pinions disengages from the rack, but not the other one; in particular, the pinion placed on the same side in which the door is made to slide is always in engagement with the rack, until the door has reached its maximum opening position. Consequently, the more the two pinions are spaced apart from each other, the greater the opening width of the sliding door Thanks to this arrangement, it is then possible to make the sliding door slide indifferently to the right or left with respect to the casing, with evident advantages in the flexibility of use of the showcase. In the case of museums where there are several showcases, this feature allows to change the arrangement of the showcases in the rooms without constraints owing to the sliding direction: a showcase of this type can in fact be placed both in the middle of the room, and approached to or in any case close to a wall on both the left and right flanks.

Furthermore, the engagement of both pinions evidently also takes place during the closing movement and therefore allows the door to be moved with greater precision when the door approaches its closing position: this actuation precision favours the perfect closing of the door.

Preferably, the two pinions are equal and are moved at the same angular speed. In this way, the angular movement of the two pinions is always synchronized, even when the rack is disengaged from one of the pinions. During the closing of the door, therefore, the rack approaching the disengaged pinion finds it perfectly in phase and therefore meshes with it smoothly, without causing any disturbance in the regularity of the movement. Consider that any irregularity in the movement of the door can cause a vibration of the showcase, with potential damage to exhibits if they are particularly delicate.

Preferably, the two pinions are rotatably moved by a single common drive shaft. This feature is particularly preferred for the evident saving of pieces, to the advantage of the reliability of the showcase as well as the containment of costs; moreover, the single common drive shaft totally guarantees a perfect synchronization between the two pinions.

Preferably, the showcase comprises a single motor which drives the drive shaft in rotation. Alternatively or in addition, it is possible to provide for a manual actuation, for example by means of a coupling which drives the drive shaft in rotation when it is connected to an external tool (for example, a crank). The motor actuation is not only preferable for large sized and therefore heavy doors, but in any case it also guarantees maximum movement smoothness.

The manual actuation ensures the movement under all conditions, for example in the absence of power supply.

Preferably, two transmissions are provided, respectively between the drive shaft and each of the two pinions. In this way, it is possible to choose in the best way the rotation speed of the pinions, regardless of the operating speed of the motor.

Preferably, the guide system comprises an upper guide mechanism and a lower guide mechanism, located respectively in proximity to an upper edge and a lower edge of the open side of the casing, where one of the two guide mechanisms is load-bearing and the sliding door is supported by it, wherein the rack is arranged in proximity to an upper or lower edge of the sliding door at the upper or lower load-bearing guide mechanism. The thrust of the pinions to move the sliding door is therefore applied where the door is supported: at the top in case of hanging doors, at the bottom for resting doors; the actuation is therefore more precise, avoiding that the door tends to wobble.

Preferably, the distance between the two pinions is equal to at least one third of the width of the open side of the casing. In this way, an opening width of the door of at least about 60% is ensured; greater distances increase the opening width more and are even more preferred, provided of course that the static conditions of the showcase allow it, that is, without the weight of the cantilevered sliding door being able to cause the showcase to tip over or the door to unhang from its guide system.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DESCRIPTION OF THE DRAWINGS

Further characteristics and advantages of a museum showcase according to the invention will become clearer from the following description of preferred embodiments thereof, made with reference to the appended drawings. In such drawings.

DETAILED DESCRIPTION

Figure 1:
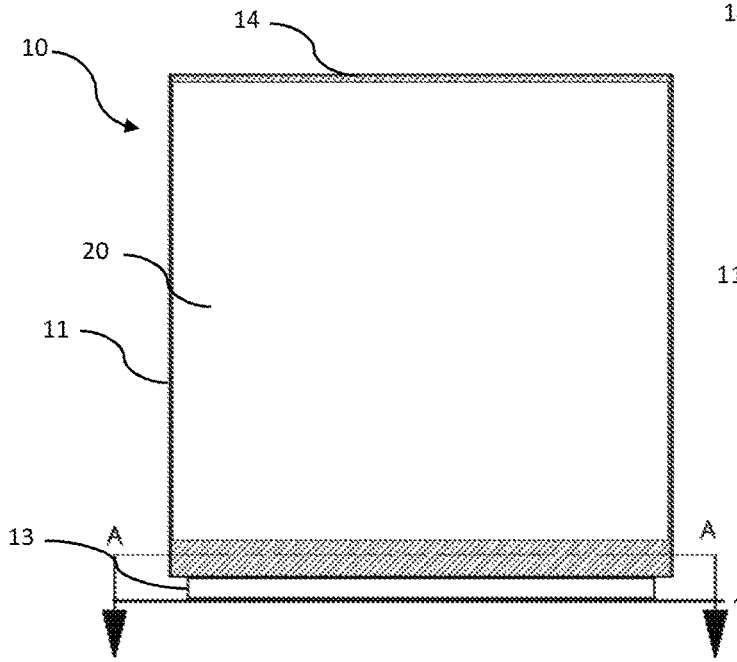
FIG. 1 is a schematic front view of a showcase according to the invention, with resting sliding door.
Figure 2:
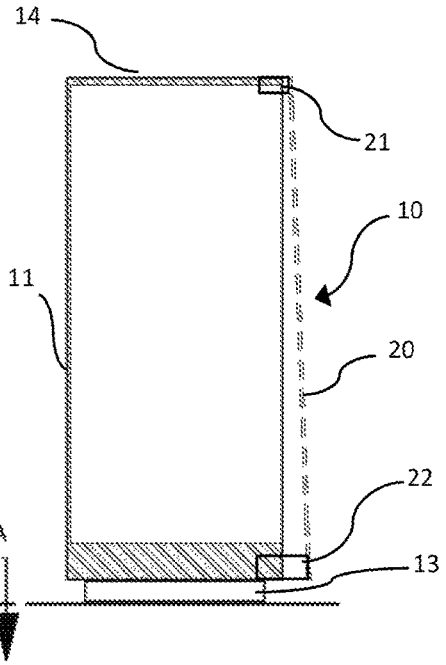
FIG. 2 is a schematic side view of the showcase of FIG. 1, with sliding door open shown with a dotted line.
Figure 3:
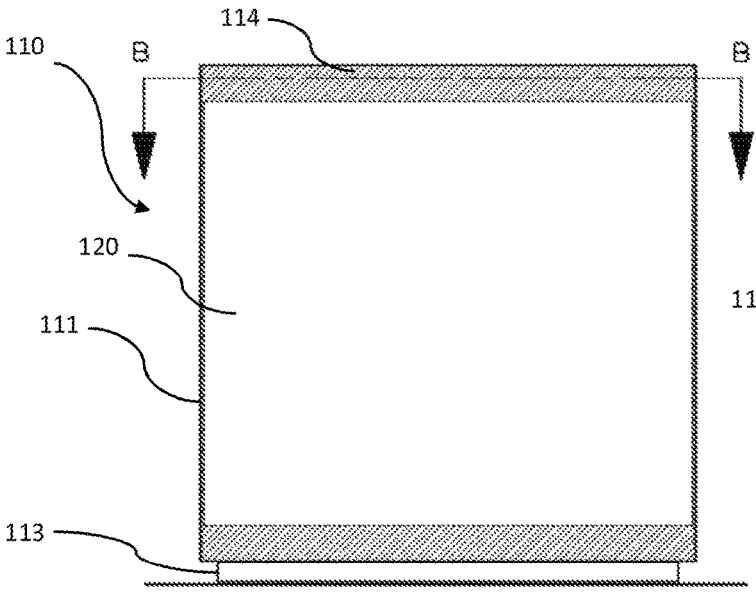
FIG. 3 is a schematic front view of a showcase according to the invention, with hanging sliding door.
Figure 4:
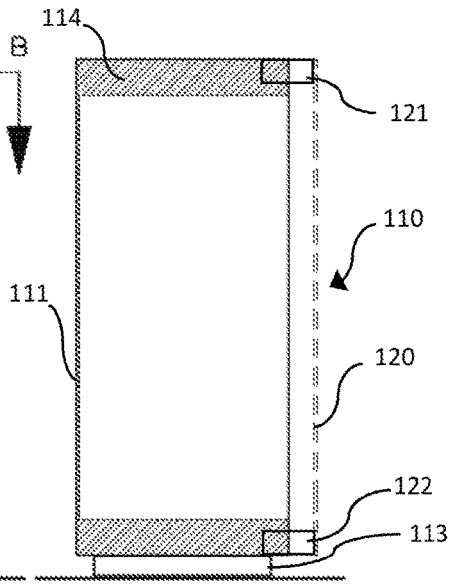
FIG. 4 is a schematic side view of the showcase of FIG. 3, with the sliding door open shown with a dotted line.
Figure 5:
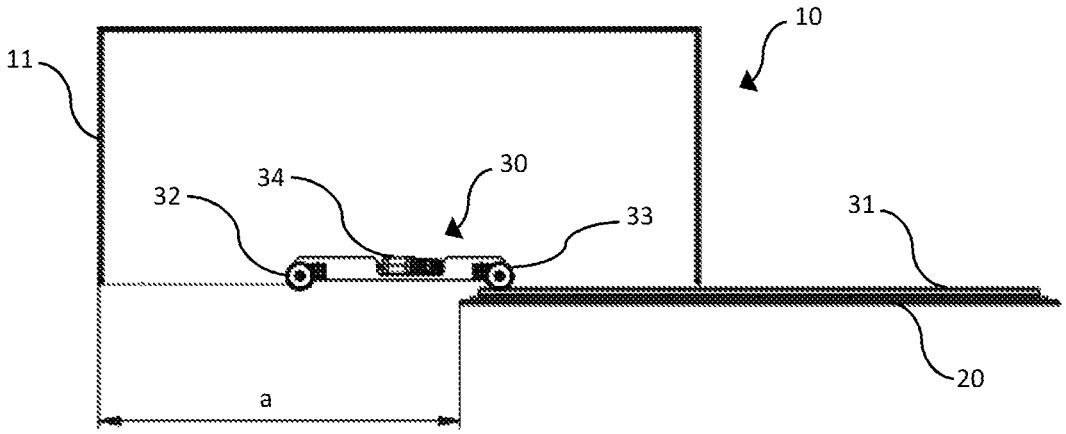
FIGS. 5 and 6 are schematic sectional plan views along the plane AA of the showcase of FIG. 1, with the sliding door open respectively to the right and to the left.

Example embodiments will now be described more fully with reference to the accompanying drawings.

Example embodiments are provided so this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

In FIGS. 1, 2, 5, 6, reference 10 indicates a museum showcase as a whole, which comprises a fixed casing 11 mounted on a base frame 13 and closed at the top by a ceiling 14. The casing 11 has an open side on the front, provided with a sliding door 20. The showcase 10 must be understood as provided with all the typical elements of a museum showcase, such as sealing gaskets, climate control systems, safety systems and the like, and it can also be provided with air purification systems, lighting systems, control systems or other, even if they are not visible in the schematic representation of the drawings; on the other hand, all these elements are per se conventional.

The door 20 substantially occupies a whole front side of the showcase 10 and as said it is a sliding door, supported by the casing 11 through a guide system which comprises an upper guide mechanism 21 and a lower guide mechanism 22; they (indicated only schematically in FIG. 2, as they are per se conventional) allow the opening and closing of the door 20 by sliding in a horizontal opening direction. More specifically, the door 20 is of the resting type, i.e. its weight is supported by the lower guide mechanism 22, while the upper guide mechanism 21 prevents it from tipping over without on the other hand supporting the weight thereof.

Figure 6:
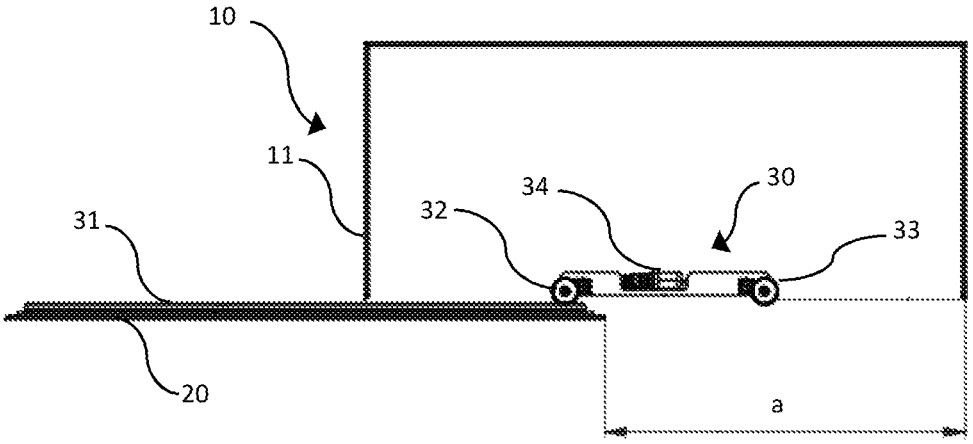
Figure 7:
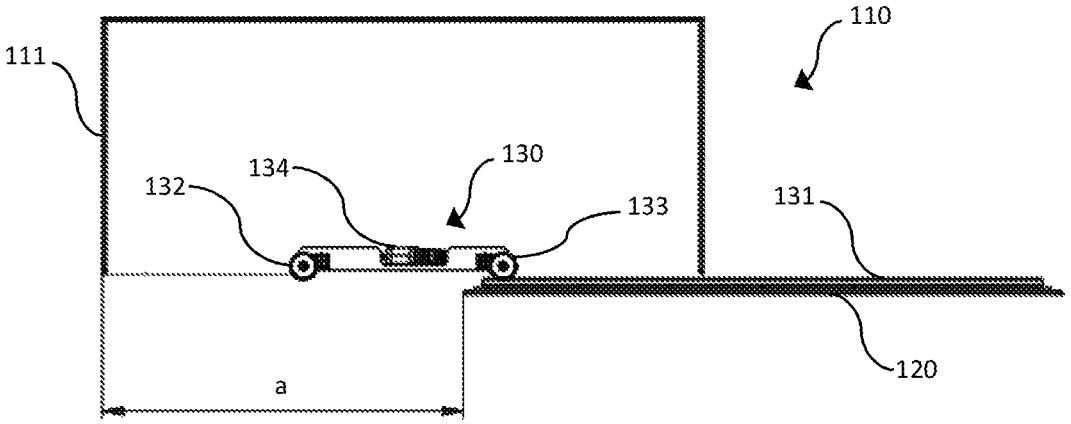
FIGS. 7 and 8 are schematic sectional plan views along the plane BB of the showcase of FIG. 3, with the sliding door open respectively to the right and to the left.
Figure 8:
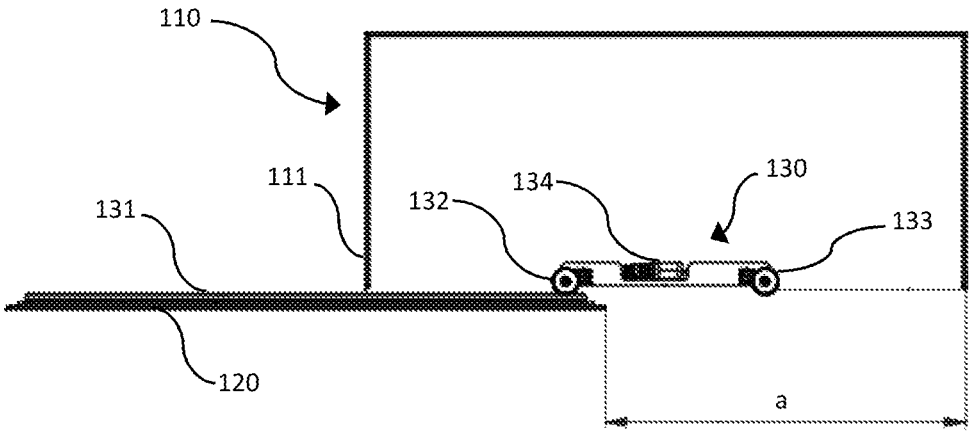

The showcase 10 comprises an actuation system 30, to allow the door 20 itself to be moved in the horizontal direction between a closing position (FIG. 1) and two different opening positions along the guide system 21, 22: an opening position to the right (FIG. 5) and an opening position to the left (FIG. 6).

The actuation system 30 (better visible in FIGS. 5 and 6 and in the enlargement of FIG. 10) is placed in the lower part of the open side of the casing 11, therefore at the lower edge of the door 20 and in proximity to the lower guide mechanism 22 which substantially bears the whole weight of the door 20.

The actuation system 30 comprises a rack 31, fixed integral with the door 20 at a lower edge thereof 23 and extending in the direction of the width of the door 20. The actuation system 30 then comprises two pinions 32 and 33, rotatably mounted on the casing 11 and driven in rotation by a single motor 34, through a single drive shaft 35, common to the two pinions 32 and 33, and two respective transmissions 36 and 37; the transmissions 36 and 37 comprise gears that are sized and arranged so as to cause a reduction in the rotation speed of the pinions 32 and 33 with respect to the rotation speed of the drive shaft 35. In a variant (not shown), a coupling can be provided on the drive shaft 35 (or in any case kinematically connected thereto), in order to be able to manually drive the drive shaft 35, with a crank or another suitable external tool.

The pinions 32, 33 are spaced apart from each other in the direction of the width of the open side of the casing 11, i.e. of the door 20. The distance between the two pinions 32, 33 is equal to at least one third of the width of the open side of the casing 11, i.e. of the door 20. With this distance, the opening width of the door 20 (indicated with a in the drawings) is equal to about ⅔ of the width of the door 20, i.e. in practice at least equal to 60% considering the overall dimensions of the moving parts. It is of course possible (and indeed preferred) to further distance the pinions 32, 33, thus increasing the opening width of the door 20, provided of course that the static conditions of the showcase 10 allow it, that is, provided that the weight of the sliding door 20—cantilevered in the maximum opening position—cannot cause the showcase 10 to tip over (if simply resting on the ground) or the door 20 to unhang from its guide system 21, 22.

The pinions 32, 33 are equal to each other, as are the two transmissions 36, 37; the pinions 32, 33 are therefore moved at the same angular speed by the common drive shaft 35.

The pinions 32, 33 are then in meshing engagement with the rack 31. More precisely, the pinions 32, 33 are simultaneously in engagement with the rack 31 when the door 20 is in the closing position or in the partial opening position, close to the closing position; by increasing the opening of the door 20 to the right, at a certain point the left pinion 32 remains disengaged and the actuation continues thanks to only the right pinion 33 up to the position of full opening (FIG. 5); correspondingly, by increasing the opening of the door 20 to the left, at a certain point the right pinion 33 remains disengaged and the actuation continues thanks to only the left pinion 32 up to the position of full opening (FIG. 6).

Obviously, the opposite occurs in the closing movements of door 20.

Starting from the full opening position to the right (FIG. 5), the door 20 is displaced to the left by the actuation of only the right pinion 33, up to a position of partial opening in which the rack 31 also engages with the left pinion 32; note that this phase occurs with maximum smoothness, since the pinion 32—even if it is disengaged—has continued to rotate synchronously with the pinion 33 and is therefore perfectly ready to receive the engagement of the rack 31. The closure of the door 20 takes therefore place under the action of both pinions 32, 33, until the position shown in FIG. 1 is reached.

Similarly, starting from the full opening position to the left (FIG. 6), the door 20 is displaced to the right by the actuation of only the left pinion 32, up to a position of partial opening in which the rack 31 also engages with the right pinion 33; note that also in this case this phase occurs with maximum smoothness, since the pinion 33—even if it is disengaged—has continued to rotate synchronously with the pinion 32 and is therefore perfectly ready to receive the engagement of the rack 31. The closure of the door 20 takes therefore place under the action of both pinions 32, 33, until the position shown in FIG. 1 is reached.

The positioning of the actuation system 30 at the bottom, at the lower guide mechanism 22 which bears the weight of the door 20, allows a more precise and smoother actuation, without jamming which would tend to cause annoying and often unacceptable vibrations of the whole showcase 10.

In FIGS. 3, 4, 7, 8, instead, a museum showcase 110 similar to showcase 10 is shown, in that it is provided with the same elements as the showcase 10; in the showcase 110, the elements corresponding to those of showcase 10 are not described herein and are marked by reference numbers increased by 100.

The showcase 110 differs from showcase 10 in that the sliding door 120 is not resting but is hung, that is supported by the upper guide mechanism 121; the lower guide mechanism 122 controls the inclination of the door 120, without however supporting the weight thereof.

Furthermore, the actuation system 130 of showcase 110 (better visible in FIGS. 6 and 7 and in the enlargement of FIG. 10) is placed in the upper part of the open side of the casing 111, therefore at the upper edge of the door 120 and in proximity to the upper guide mechanism 121 which substantially bears the whole weight of the door 120.

Figure 9:
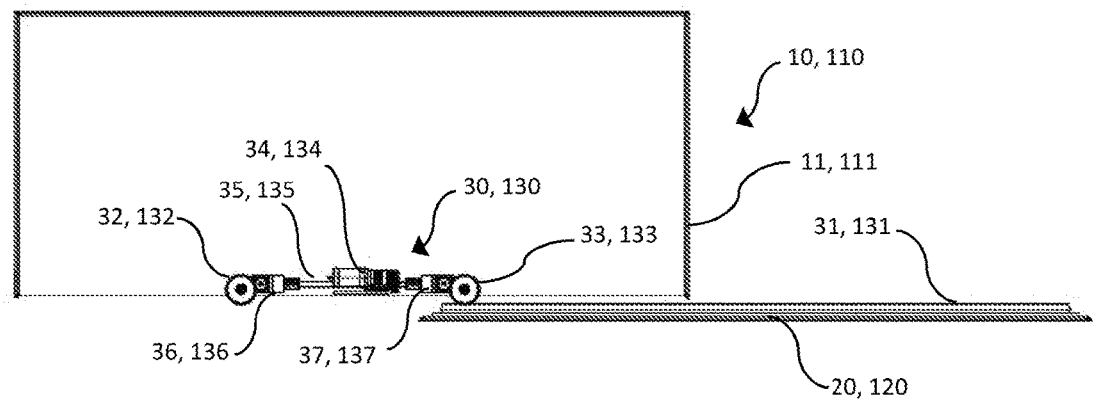
FIG. 9 is a schematic sectional view of the showcase of FIG. 5 (as well as of the showcase of FIG. 7), with parts removed to better show the actuation system.
Figure 10:
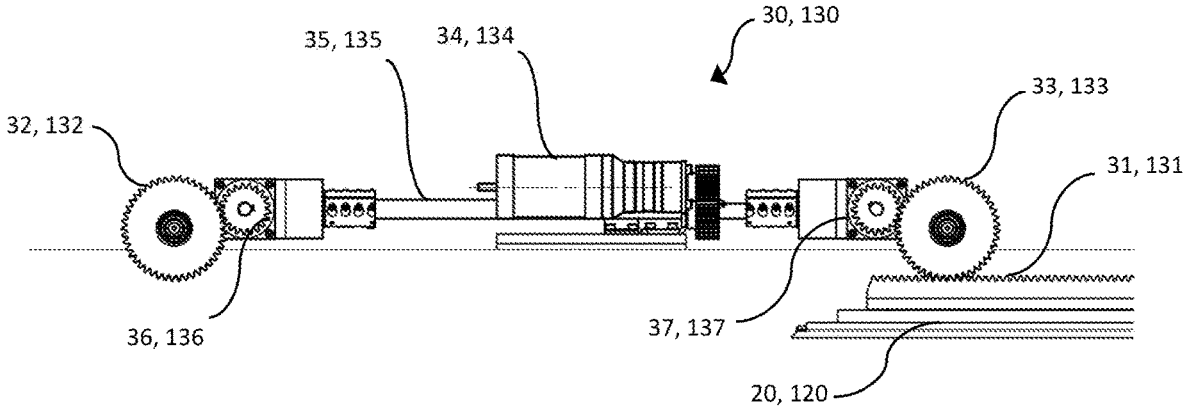
FIG. 10 is an enlarged scale view of the actuation system shown in FIG. 9.

As to the rest, as can be clearly seen from the figures, the actuation system 130 is equal to the actuation system 30 of the showcase 10, so much so that the FIGS. 9 and 10 are representative of both.

In a functionally similar way to what is envisaged in showcase 10, the positioning of the actuation system 130 at the top, at the upper guide mechanism 121 which bears the weight of the door 120, allows a more precise and smoother actuation, without jamming which would tend to cause annoying and often unacceptable vibrations of the whole showcase 110.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A museum showcase comprising a casing with at least one open side, a sliding door for closing the at least one open side of the casing, a guide system to allow the horizontal displacement of the sliding door with respect to the casing, and an actuation system to cause the horizontal displacement of the sliding door on the guide system wherein the actuation system comprises:

a rack, integral with the sliding door and extending in a direction of a width of the sliding door, two drive pinions rotatably mounted on the casing and in meshing engagement with the rack, wherein the two drive pinions are arranged spaced apart from each other in the direction of the width of the at least one open side of the casing; and wherein the rack is in a meshing engagement with both of the two drive pinions when the sliding door in is a closed position and wherein the rack is in meshing engagement with only one of the two drive pinions when the sliding door is in a fully opened position.

2. The showcase according to claim 1, wherein the two drive pinions are equal and are moved at a same angular speed.

3. The showcase according to claim 2, wherein the two drive pinions are rotatably moved by a single common drive shaft.

4. The showcase according to claim 3, comprising two transmissions, with one said transmission positioned between the single common drive shaft and each of the two drive pinions.

5. The showcase according to claim 3, comprising a single motor which drives the single common drive shaft in rotation.

6. The showcase according to claim 3, comprising a coupling which drives the single common drive shaft in rotation when connected to an external tool.

7. The showcase according to claim 1, wherein the guide system comprises an upper guide mechanism and a lower guide mechanism, located respectively in proximity to an upper edge and a lower edge of the at least one open side of the casing, where one of the two guide mechanisms is load-bearing and the sliding door is supported by said one of the two guide mechanisms, wherein the rack is arranged in proximity to an upper or lower edge of the sliding door at said one of the two guide mechanism.

8. The showcase according to claim 1, wherein a distance between the two drive pinions is equal to at least one third of the width of the at least one open side of the casing.

* * * * *